United States Patent [19]

Mayer

[11] Patent Number: 4,756,827

[45] Date of Patent: Jul. 12, 1988

[54] LIQUID FLOW DRAINAGE CONTROL

[75] Inventor: Robert B. Mayer, Manassas, Va.

[73] Assignee: American Manufacturing Co., Inc., Manassas, Va.

[21] Appl. No.: 16,775

[22] Filed: Feb. 20, 1987

[51] Int. Cl.[4] ..... E03F 11/00

[52] U.S. Cl. ..... 210/170; 210/532.2; 138/45; 137/577; 285/178

[58] Field of Search ..... 210/100, 170, 532.2; 137/577, 577.5; 138/96 R, 96 T, 40, 45, 46; 285/178, 109, 331, 397, 425, 901, 925

[56] References Cited

U.S. PATENT DOCUMENTS

| | | | |
|---|---|---|---|
| 3,394,951 | 7/1968 | Crivello | 285/397 |
| 3,904,524 | 9/1975 | Pelton et al. | 210/532.2 |
| 4,112,979 | 9/1978 | Niddicombe | 138/96 R |
| 4,298,470 | 11/1981 | Stallings | 210/532.2 |
| 4,645,177 | 2/1987 | Moakes | 285/178 |
| 4,663,036 | 5/1987 | Strobl, Jr. et al. | 210/532.2 |

*Primary Examiner*—Peter Hruskoci
*Assistant Examiner*—Richard D. Jordan
*Attorney, Agent, or Firm*—C. Lamont Whitham; Michael E. Whitham

[57] ABSTRACT

Improvements are disclosed for liquid flow drainage control in gravity type systems such as sewage septic tank systems. A plastic cap which is insertable into the ends of the drainage pipes that project into a distribution box is formed with an end face and a cylindrical body. The end face is generally circular having a larger diameter than the outer diameter of the drainage pipes into which the cap is to be inserted. The outer periphery of the end face is provided with an interdigital or scalloped pattern to facilitate easy gripping even in the most adverse conditions. The end face is further provided with an eccentric discharge hole which is located along a diameter of the end face so that the hole is always some distance from the interior surface of the cylindrical body so that the hole forms a weir to the inlet of the drainage pipe into which the end cap is inserted. The eccentric hole is provided with an outwardly projecting flange which, in cooperation with a spirit level, is used for rough leveling. The cylindrical body is made of a pliant material allowing it to conform to the irregular internal diameter of a plastic drainage pipe. The projecting end of the cylindrical body is provided with a radially extending sealing flange which also conforms to the internal diameter of the plastic drainage pipe.

15 Claims, 2 Drawing Sheets

LIQUID FLOW DRAINAGE CONTROL

BACKGROUND OF THE INVENTION

1. Field of the Invention

The present invention generally relates to liquid flow drainage control in sewage septic tank systems and, more particularly, to an improved drainage pipe flow control comprising a cap insertable from within the distribution box into a projecting end of a drainage pipe and easily adjustable to equalize the drainage of liquid from the box.

2. Description of the Prior Art

Sewage septic tank systems generally comprise a septic or holding tank which receives the raw sewage from a main inlet pipe. A distribution box is connected to receive liquid or effluent discharged from the septic tank. The distribution box is provided with a plurality of outlets at a predetermined distance from the top of the box. These outlets are connected to drainage pipes which are in turn connected to a drainage field. In the drainage field, the drainage pipes are perforated to allow liquid carried by the drainage lines to leach into the surrounding earth. The solids in the raw sewage in the septic tank settle to the bottom of the tank while the liquid or effluent, when it reaches the level of the outlet of the septic tank, flows to the distribution box. From there, the effluent flows through the drainage pipes to the drainage field.

In such sewage septic tank systems, it is necessary for the proper operation of the system and the long life of the drainage field for the discharge into the drainage pipes from the outlets of the distribution box to be absolutely at the same level so that the same flow rate is maintained in each of the drainage pipes. The criticality of this adjustment is due to the slow flow rates of the effluent within a gravity feed system. Precise adjustment to within approximately one sixteenth of an inch or less is desired. The distribution box is typically made of cast concrete and, more recently, of molded plastic. The outlets can be precisely and accurately formed in the mold which is used to cast or mold the box. The problem is one of installation. In spite of the most careful preparation of the hole at the site where the distribution box is to be installed, the box will not be precisely level. As a practical matter, the workmen who routinely install these boxes do not make as careful preparation of the hole as would be desirable, aggravating still further the problem of compensating for the out of level condition of the box so as to provide for an unequalized flow rate of effluent into the drainage pipes. Other factors affecting the flow rate are the grades of each drainage pipe and the soil conditions surrounding the drainage pipe.

When the drainage lines were made of clay tile, it was the procedure to put a trowel of mortar in the openings of the outlets through which the tiles projected. After the mortar dried, the distribution box was filled with water to the level of the outlets. Mortar was then chiseled away as necessary so that the flow out of the outlets was equalized.

With the advent of plastic pipe, such as polyvinylchloride (PVC) and other plastics, designed for septic system drainage fields, the clay tile was no longer used because the plastic pipe was both cheaper and much less fragile. Nevertheless, the problem of equalizing the flow rates remained, but mortar does not adhere well to the plastic pipe. The solution was to form a dam of tar or asphalt in the ends of the drainage pipes and then add or remove tar or asphalt as needed. In other words the tar or asphalt served the same function as the mortar but of course would adhere to the plastic pipe; however, the process in addition to being tedious was quite messy. Another proposed solution was to drill a hole or cut a slot in a standard plastic end cap. The plastic end cap was of the type having a decreasing tape to its inside diameter and intended to make a jam fit over the end of the plastic pipe projecting into the distribution box. The hole or slot in the end cap was off center so that as the end cap was positioned before being jam fit over the end of the pipe projecting into the distribution box, a rough adjustment of the level at which effluent would flow into the drainage line could be made.

One problem with the end cap solution was that for it to function properly, it was necessary for the connection to the drainage line to be sealed. This was accomplished by using a solvent adhesive which "welded" the end cap to the plastic pipe. This could not be applied with water in the distribution box so that after adjustments were made and marked, the box would have to be at least partially drained. Furthermore, if there were any inaccuracies in the marking or installing of the end cap and pipe combinations, there could be no adjustments. The seal to the drainage line was permanent.

If no solvent were used to seal the end cap to the pipe, and reliance were merely placed on the friction jam fit between the pieces for sealing the pieces, rotation of the cap would require loosening before the cap could be readily rotated. This, however, would typically lead to leakage between the end cap and the pipe, and thus make precise rotatable adjustment of flow difficult if not impossible.

Still other proposals have included the use of a special long handled tool or wrench adapted to be inserted into multiple holes drilled in a conventional plastic end cap. However, end caps having multiple holes are not useful at all in certain applications and, moreover, such structure would most likely leak in any event during rotational adjustment. In addition, the forces applied by such a tool or wrench could break the end of the drainage pipe or destroy the seal between the drainage pipe and the distribution box causing the box to leak.

The problems associated with the plastic end cap and pipe combination were partially solved by the device disclosed in U.S. Pat. No. 4,298,470 issued to Billy G. Stallings. Stallings discloses a liquid leveling cap with an eccentric discharge hole in the end face of the cap. The cap fits over the pipe projecting into the distribution box and is rotatable so that the levels of the holes of the several end caps in the distribution box can be precisely adjusted. The Stallings liquid leveling end cap was rotatably secured to the pipe and allowed for relatively freer rotation of the end cap on the pipe to permit adjustment of the liquid levels admitted to the drainage pipes without significant leakage.

Although sanitary regulations adopted by many jurisdictions over the past two decades have required equal flow rates of effluent in the drainage pipes, those working in the field have not fully appreciated these requirements or how to comply with them.

SUMMARY OF THE INVENTION

It is therefore a general object of the present invention to provide improvements in the flow control of the drainage from a septic tank system.

It is another, more specific object of the invention to provide in a septic tank system a means for both roughly adjusting the level of the drainage pipe openings when the distribution box is first set in position and the drainage pipes are inserted and then when installation is complete, making a precise and fine adjustment of the actual flow rates for the several drainage pipes.

It is yet another object of the invention to provide an inexpensive device which is easily adjusted to facilitate equalized distribution of effluent in the drainage pipes of a sewage septic tank system.

According to the the invention, a plastic cap which is insertable into the ends of the drainage pipes is formed with an end face and a cylindrical body. The end face is generally circular having a larger diameter than the outer diameter of the drainage pipes into which the cap is to be inserted. The outer periphery of the end face is provided with an interdigital or scalloped pattern to facilitate easy gripping even in the most adverse conditions of temperature, moisture and sludge. The end face is further provided with an eccentric circular discharge hole. This circular discharge hole is located along a diameter of the end face so that the hole is always spaced some distance from the interior surface of the cylindrical body. Thus, the edge of the hole, no matter how the end cap is rotated, always forms a weir to the inlet of the drainage pipe into which the end cap is inserted. The minimum spacing of the circular discharge hole from the inside diameter to maintain a weir effect for any particular application can be calculated for the anticipated flow rates for that application. While the weir effect is most important to controlling flow rates, there are times when the distribution box may become flooded and the effluent level rises above the top edge of the circular discharge hole. Under this condition, the hole acts as an orifice, the flow characteristics of which are known and predictable. Further, the eccentric hole is provided with a flange at least on the face side of the end face extending perpendicular to the end face forming a right circular cylinder normal to the plane of the end face. This flange is used for rough leveling using, for example, a spirit level. The cylindrical body is made of a pliant material allowing it to conform to the irregular internal diameter of a plastic drainage pipe. The projecting end of the cylindrical body is provided with a radially extending sealing flange which also conforms to the internal diameter of the plastic drainage pipe. Preferrably, the radially extending sealing flange projects back toward the end face so that any leakage between the cylindrical body and the plastic pipe tends to force the seal more firmly against the pipe.

BRIEF DESCRIPTION OF THE DRAWINGS

The foregoing and other objects, aspects and advantages of the invention will be better understood from the following detailed description of the invention with reference to the drawings, in which.

DETAILED DESCRIPTION OF THE INVENTION

Figure 1:
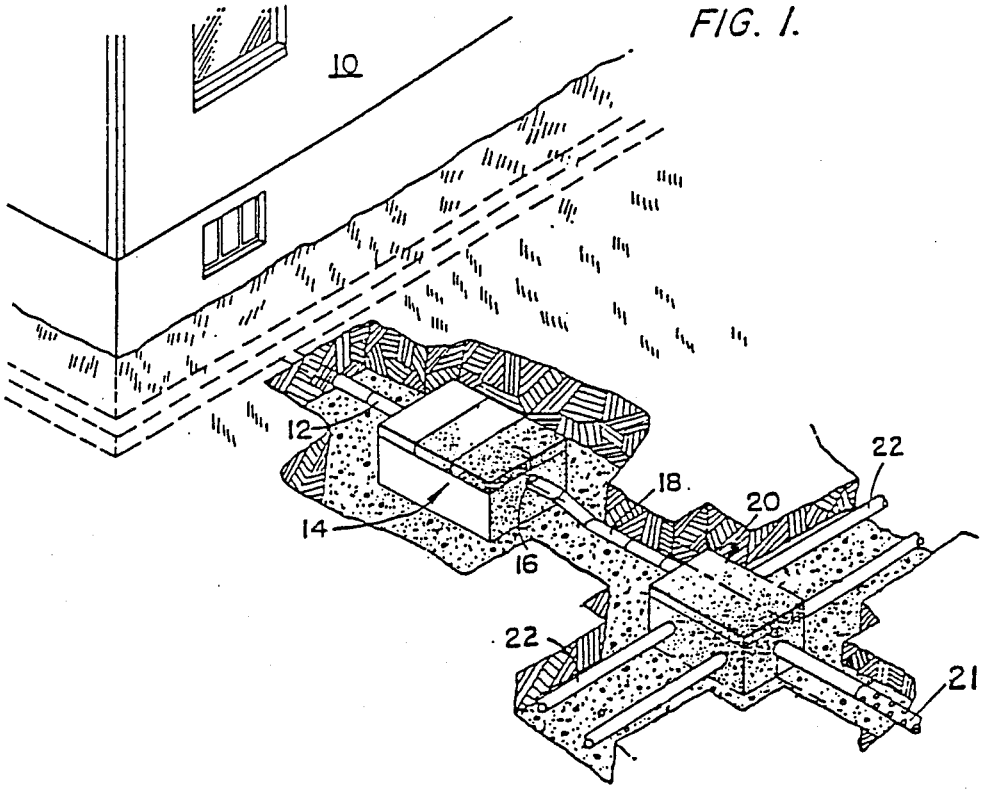
FIG. 1 is a pictorial illustration of a septic tank system of the type with which the subject invention is used.

Referring now to the drawings, and more particularly to FIG. 1, there is shown a septic tank system comprising an inlet pipe 12 which transmits raw sewage from a building such as a residential house 10, for example, to a septic tank 14. The septic tank 14 is connected from a discharge outlet 16 via a pipe 18 to a distribution box 20. The distribution box 20, besides having an inlet from pipe 18, is provided with a plurality of outlets which receive drainage pipes 22. These drainage pipes are connected to perforated pipes 21 in a drainage field (not shown).

Figure 2:
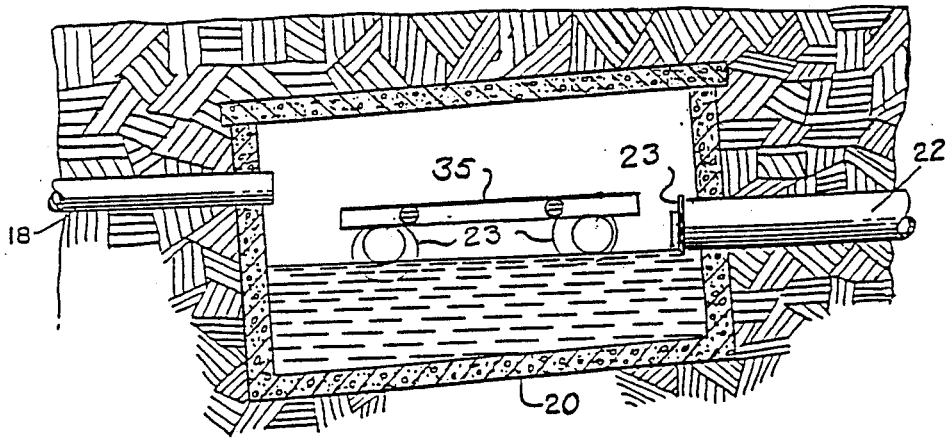
FIG. 2 is a view of the interior of a distribution box in the septic tank system shown in FIG. 1 showing two end caps according to the invention installed on the ends of drainage pipes.

A portion of the interior of the distribution box 20 is shown in FIG. 2. Of particular interest to the present discussion is the location of the ends of the drainage pipes 22. These are a predefined distance from the top of the box 20, and the requirement is that the flow rates out of the box from these outlets be equalized. The ends of drainage pipes 22, three of which are shown for purposes of illustration, project into the box 20. As shown in FIG. 2, these are provided with end caps 23, shown in more detail in FIGS. 3 and 4.

Figure 4:
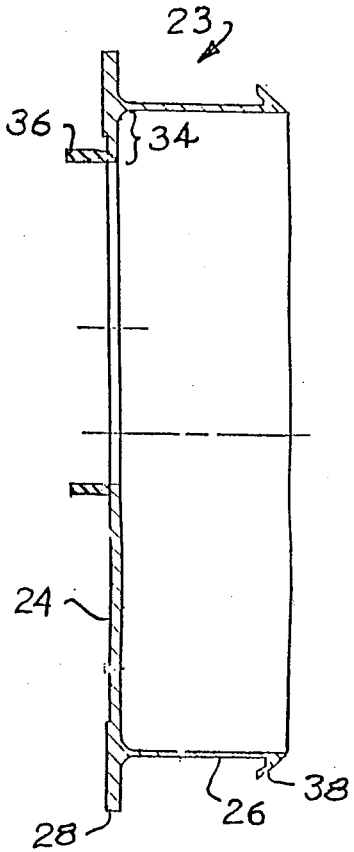
FIG. 4 is a side, cross-sectional view of the end cap shown in FIG. 3.
Figure 3:
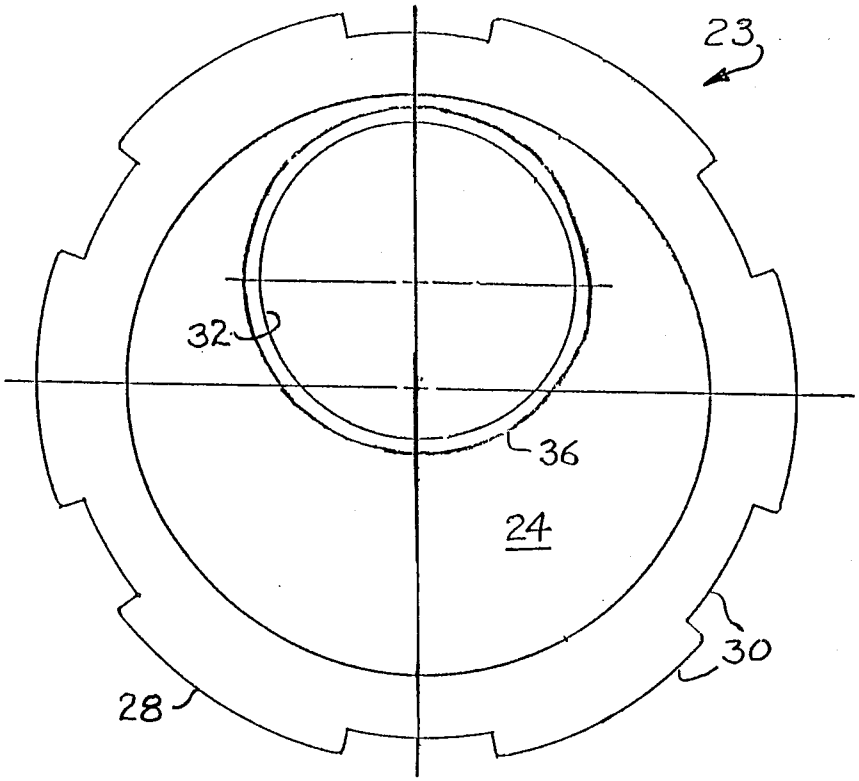
FIG. 3 is a plan view of a preferred embodiment of an end cap as shown in FIG. 2.

Referring to FIGS. 3 and 4, a preferred embodiment of an end cap is shown as comprising an end face 24 of generally circular geometry and a cylindrical body 26 attached to the end face. Both the end face 24 and the cylindrical body 26 are formed of a molded plastic. This may be done by forming both parts separately in individual dies and then joining the parts with an adhesive, by a sonic weld or with a snap fit. If this construction is followed, the end face 24 may be made of a high density polyethylene and the cylindrical body 26 may be made of a low density polyethylene. Alternatively, the end face 24 and the cylindrical body 26 may be integrally molded in a single die thus eliminating the need to join two parts and the attendant expense of that step. In the case of an integral construction, a low density polyethylene may be used. Those skilled in the plastics arts will, of course, understand that other materials may be used. The use of the high density plastic in the two part construction allows for a more rigid end face which can be an advantage, but as will be described in more detail hereinafter, similar characteristics can be achieved with the integral construction.

The end face 24 is of a larger diameter than the outside diameter of the drainage pipes 22. This is to provide for an edge 28 which may be gripped so as to rotate the end cap within the end of the drainage pipe. To further enhance the gripping edge 28 of the end face, the outer periphery is provided with an interdigital pattern 30. A scalloped or other such pattern may be provided for the same purpose. The idea is to provide a sure grip under all kinds of adverse conditions such as cold temperatures when gloves may be worn by the workmen or when the end cap is wet or covered with sludge making it slippery. Since the end cap 23 is relatively easy to rotate within the end of the drainage pipe 22 and a sure gripping edge 28 is provided, there is no requirement for a separate tool to rotate end cap to adjust flow rates.

The end face 24 is further provided with an eccentric circular hole 32 along a diameter of the end face. An important criteria for the hole 32 is that it is not tangential to the inner diameter of the cylindrical body 26. That is, there is a prescribed distance 34 between the nearest edge of the hole 32 and the interior surface of the cylindrical body 26. The reason for this is to provide a weir between the water level in the box 20 and the interior of the drainage pipe 22. It is very important in a gravity system, such as a septic system, that this weir be present for all of the drainage pipes. Flow characteristics over a weir are different than those directly into a pipe, and where there is a requirement for equalizing the flow rate in a gravity system, a weir provides the ideal characteristics. The flow rate over a weir is essentially a function of gravity and since gravity is a constant at each drainage pipe 22 in the box 20, the flow rates will be identical and predictable for each drainage pipe. However, flow into a pipe is a function of several factors including the grade of the pipe, the interior surface friction of the pipe, the characteristics of the soil surrounding the pipe, and the back pressure resisting the flow of liquid within the pipe. Even under ideal conditions, these variables are not constant from pipe to pipe. This means that although, for example, pipe levels may be the same, the flow rates within those pipes may nevertheless be different.

It is also desirable that the hole 32 be circular so that the characteristics of the weir presented to effluent in the distribution box be the same no matter how the end cap is rotated. The minimum spacing of the hole 32 from the inside surface of the cylindrical body 26 to maintain the weir effect can be determined for a particular application by calculations based on anticipated flow rates.

There may be times when the distribution box becomes flooded, such as under storm conditions or when the system is being pumped out, so that the effluent level rises above the top edge of the circular discharge hole 32. Under these conditions, the hole acts as an orifice the flow characteristics of which are predictable and can be readily calculated for a given application. The size of hole 32 must therefore be sufficiently large to allow sufficient flow rates so that the distribution box 20 does not over flow; i.e., a maximum flow rate can be accomodated during flooding conditions. On the other hand, it is desirable to make the hole as small as possible and as close to the inside diameter of the cylindrical body 26 so that the maximum possible vertical displacement of the hole with rotation of the end cap on the discharge pipe can be achieved. Given these constraints, the size of the hole and its spacing from the inside diameter of the cylindrical body 26 may be determined for any given application.

An outwardly projecting flange 36 is formed about the hole 34. This flange 36 extends perpendicular to the end face 24 forming a right circular cylinder normal to the plane of the end face. The purpose of this flange 36 is to provide a point of reference between end caps 23 within the box 20 for making a rough leveling on initial installation. As better shown in FIG. 2, when the box 20 is first installed and drainage pipes 22 inserted into outlets 16, the end caps 23 may be installed into the ends of the drainage pipes. A spirit level 35 can be rested atop the flanges 36 of two or more of the end caps 23, and the end caps then rotated to provide a rough level condition. This may typically be done before the trenches in which the drainage pipes 22 are laid have been filled in with gravel and fill dirt. Final adjustments to the flow rates for the several drainage pipes are made after the trenches have been filled and the box 20 is filled with water. At this point, very precise adjustments in the flow rates can be made owing in part to the weir design of the end caps.

Referring back to FIGS. 3 and 4, the flange 36 serves a second function and that is to provide some stiffening to the end face 24. This is particularly advantageous when the integral construction of the end cap is employed. Further stiffening may be provided by extending the flange into the interior of the end cap 23, although this is not necessary. More stiffening to the end face 24 is provided by increasing the thickness of the gripping edge 28 from a point along the diameter of the end face roughly corresponding to the distribution of the end face to the cylindrical body 26. The amount of increased thickness is a matter of design depending on the relative stiffness of the plastic material used to make the end face.

The cylindrical body 26 projects into the end of a drainage pipe 22 and has an outside diameter approximately equal to the inside diameter of the plastic drainage pipe. The standards for the manufacture of plastic pipe specify minimum wall thickness for strength of the pipe and outside diameter within a very close range of tolerance. The outside diameter is kept to close tolerance so that distributions, terminations and end caps made for fitting to plastic pipe will closely fit and provide a tight seal when the solvent adhesive is applied. However, no similar close tolerance is required for the inside diameter of the pipe, and many commercially available plastic pipes exhibit irregular and often out of round internal diameters. This poses a problem in trying to provide a seal between an end cap, such as end cap 23, and the inside of the end of a drainage pipe 22. It is one reason why the prior art attempted to use standard end caps for plastic pipes which fit over, not inside, the ends of the drainage pipes.

By making the cylindrical body 26 of a pliant plastic material, the body 26 can deform and conform to the shape of the inside of the drainage pipe. The seal between the cylindrical body 26 and the inside of the drainage pipe is made by means of a radially extending seal 38 at the projecting end of the cylindrical body. This seal 38 is integrally formed with the cylindrical body of the same pliant plastic material so that it readily conforms with the internal surface of the end of the drainage pipe. To further enhance the seal between the cylindrical body 26 and the inside of the the end of the drainage pipe, the radially extending seal 38 is formed at an angle to the perpendicular of the axis of the cylindrical body 26. More particularly, the seal 38 projects toward the end face 24 of the end cap 23 so as to resist removal of the end cap once inserted. Should there be any leakage of liquid between the cylindrical body 26 and the inside surface of the end of the drainage pipe 22, that leakage will tend to force the seal 38 more tightly against the inside surface of the pipe, thereby further promoting the seal between the two.

While the invention has been described in terms of a single, preferred embodiment, those skilled in the art will recognize that the invention may be practiced with modification within the spirit and scope of the appended claims.

Having thus described my invention, what I claim as new and desire to secure by Letters Patent is as follows:

1. A liquid flow control means for providing drainage flow rate control of a liquid effluent from a distribution box, said liquid flow control means including an end cap for a drainage pipe in said distribution box, said end cap comprising:

an end face of generally circular geometry and having a diameter greater than an outside diameter of said drainage pipe, said end face being provided with an eccentric hole through which said effluent may be discharged from said distribution box into said drainage pipe;

a cylindrical body attached to said end face along a common axial alignment therewith, said cylindrical body having an outside diameter approximately equal to an inside diameter of said drainage pipe and being made of a pliant material so as to deform and conform to a shape of said inside diameter of said drainage pipe, said cylindrical body further having a radially extending sealing means for making a seal with said inside diameter of said drainage pipe but allowing rotation of said cylindrical body within said drainage pipe, said hole in said end face being spaced away from an inside surface of said cylindrical body so as to form a weir between said effluent in said distribution box and said inside diameter of said drainage pipe; and means for facilitating easy rotation of said end cap when said cylindrical body is inserted in a drainage pipe to variably position said eccentric hole with respect to an effluent level within said distribution box and thereby control the rate of effluent flowing into said drainage pipe, said means for rotating comprising a gripping surface about the periphery of said end face.

2. An end cap as recited in claim 1 wherein said eccentric hole is a circular hole so that the weir formed by the hole is the same at all rotations of the end cap on the pipe.

3. An end cap as recited in claim 2 wherein said end face further includes means for making an approximate leveling adjustment of the eccentric holes in said end cap and a cooperating second end cap, said means comprising an outwardly projecting cylindrical flange coaxial with and surrounding said eccentric circular hole, said flange providing a supporting surface for a leveling device, whereby said leveling device when supported on the flanges of said end caps facilitates the making of an approximate adjustment of the levels of the eccentric boles.

4. An end cap as recited in claim 2 wherein said gripping surface comprises an interdigital pattern formed in a peripheral edge of said end face.

5. An end cap as recited in claim 2 wherein said radially extending sealing means is located at a projecting end of said cylindrical body and is a sealing flange inclined from a perpendicular to the axis of said cylindrical body toward said end face forming a structure that resists removal of said end cap once inserted into said drainage pipe but allows rotation of said cylindrical body within said drainage pipe, said sealing flange being integral with and made of the same pliant material as said cylindrical body so as to deform and conform to said shape of said inside diameter of said pipe.

6. An end cap as recited in claim 2 wherein said end face and said cylindrical body are integrally formed of the same pliant material.

7. An end cap as recited in claim 6 wherein said pliant material is a low density molded polyethylene.

8. An end cap as recited in claim 2 wherein said end face further includes leveling means for making an approximate leveling adjustment of the eccentric holes of said end cap and a second end cap, said leveling means comprising an outwardly projecting cylindrical flange coaxial with and surrounding said eccentric circular hole, said flange providing a supporting surface for a leveling device, whereby said leveling device when supported on the flanges of said end caps facilitates the making of an approximate adjustment of the levels of the eccentric holes, said gripping surface comprises an interdigital pattern formed in a peripheral edge of said end face, said radially extending sealing means is located at a projecting end of said cylindrical body and is a sealing flange inclined from a perpendicular to the axis of said cylindrical body toward said end face forming a structure that resists removal of said end cap once inserted into said pipe end but allows rotation of said cylindrical body within said drainage pipe, said sealing flange being integral with and made of the same pliant material as said cylindrical body so as to deform and conform to said shape of said inside diameter of said pipe, and said end face and said cylindrical body are integrally formed of the same pliant material.

9. A septic tank system comprising:

a septic tank for receiving raw sewage;

a distribution box connected by an inlet pipe to said septic tank for receiving an effluent discharged from said septic tank, said distribution box comprising a top, a bottom, and a plurality of side walls, at least two of said side walls including apertures;

a plurality of drainage pipes for distributing said effluent into a septic drain field, each of said drainage pipes including an end projecting into said distribution box through an aperture in one of said plurality of side walls; and drainage flow control means for providing an equal flow rate of said effluent into said drainage pipes comprising a plurality of end caps, one end cap for each of said projecting drainage pipe ends in said distribution box, each of said end caps comprising:

(i) an end face of generally circular geometry and having a diameter greater than an outside diameter of said drainage pipe end, said end face being provided with an eccentric hole through which said effluent may be discharged from said distribution box into said drainage pipe, (ii) a cylindrical body attached to said end face along a common axial alignment therewith, said cylindrical body having an outside diameter approximately equal to an inside diameter of said drainage pipe and being made of a pliant material so as to deform and conform to a shape of said inside diameter of said drainage pipe, said cylindrical body further having a radially extending sealing means for making a seal with said inside diameter of said drainage pipe but allowing rotation of said cylindrical body within said drainage pipe, said hole in said end face being spaced away from an inside surface of said cylindrdical body so as to form a weir between said effluent in said distribution box and said inside diameter of said drainage pipe, and (iii) means for facilitating easy rotation of said end cap when said cylindrical body is inserted in a drainage pipe to variably position said eccentric hole with respect to an effluent level within said distribution box and thereby control the rate of effluent flowing into said drainage pipe, said means for rotating comprising a gripping surface about the periphery of said end face.

10. A septic tank system as recited in claim 9 wherein said end face of each of said end caps in said drainage flow control means further includes leveling means for making an approximate leveling adjustment of the eccentric holes in two of said end caps, said leveling means comprising an outwardly projecting cylindrical flange coaxial with and surrounding said eccentric hole, said flange providing a supporting surface for a leveling device, whereby said leveling device when supported on the flanges of two of said end caps facilitates the making an approximate leveling adjustment of the eccentric holes in said two end caps.

11. A septic tank system as recited in claim 9 wherein said end face of each of said end caps in said drainage flow control means further includes leveling means for making an approximate leveling adjustment of the eccentric holes in said end cap and a second end cap, said leveling means comprising an outwardly projecting cylindrical flange coaxial with and surrounding said eccentric hole, said flange providing a supporting surface for a leveling device, whereby said leveling device when supported on the flanges of two of said end caps facilitates the making of an approximate leveling adjustment of the eccentric holes in said two end caps, said gripping surface of each of said end caps comprises an interdigital pattern formed in a peripheral edge of said end face of each of said end caps, said radially extending sealing means being located at a projecting end of said cylindrical body and being a sealing flange inclined from a perpendicular to the axis of said cylindrical body toward said end face of each of said end caps forming a structure that resists removal of said end cap once inserted into said drainage pipe end but allows rotation of said cylindrical body within said drainage pipe, said sealing flange being integral with and made of the same pliant material as said cylindrical body so as to deform and conform to said shape of said inside diameter of said drainage pipe, and said end face and said cylindrical body of each of said end caps being integrally formed of the same pliant material.

12. A septic tank system as recited in claim 9 wherein said gripping surface of each of said end caps in said drainage flow control means comprises an interdigital pattern formed in a peripheral edge of said end face.

13. A septic tank system as recited in claim 9 wherein said radially extending sealing means of each of said end caps in said drainage flow control means is located at a projecting end of said cylindrical body and is a sealing flange inclined from a peripendicular to the axis of said cylindrical body toward said end face forming a structure that resists removal of said end cap once inserted into said drainage pipe end but allows rotation of said cylindrical body within said drainage pipe, said sealing flange being integral with and made of the same pliant material as said cylindrical body so as to deform and conform to said shape of said inside diameter of said drainage pipe.

14. A septic tank system as recited in claim 9 wherein said end face and said cylindrical body of each of said end caps in said drainage flow control means are integrally formed of the same pliant material.

15. A septic tank system as recited in claim 14 wherein said pliant material is a low density molded polyethylene.

* * * * *